US008841851B2

(12) United States Patent
Cho et al.

(10) Patent No.: US 8,841,851 B2
(45) Date of Patent: Sep. 23, 2014

(54) LIGHT EMITTING DIODE DRIVING APPARATUS

(75) Inventors: Janghwan Cho, Seoul (KR); Jeongin Cheon, Seoul (KR); Dohyung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 13/568,515

(22) Filed: Aug. 7, 2012

(65) Prior Publication Data

US 2013/0264960 A1 Oct. 10, 2013

(30) Foreign Application Priority Data

Apr. 5, 2012 (KR) ..... 10-2012-0035540

(51) Int. Cl.
*H05B 37/02* (2006.01)

(52) U.S. Cl.
USPC ..... 315/201; 315/228; 315/250; 315/294; 315/312

(58) Field of Classification Search
None
See application file for complete search history.

(56) References Cited

U.S. PATENT DOCUMENTS

2012/0098448 A1* 4/2012 Kang et al. ..... 315/201
2013/0200802 A1* 8/2013 Sakuragi et al. ..... 315/122
2013/0307424 A1* 11/2013 Gray et al. ..... 315/193

FOREIGN PATENT DOCUMENTS

JP 2012-009271 A 1/2012
KR 10-2009-0083782 A 8/2009

* cited by examiner

*Primary Examiner* — Jany Richardson
(74) *Attorney, Agent, or Firm* — Ked & Associates, LLP

(57) ABSTRACT

A light emitting diode (LED) driving apparatus is disclosed. The LED driving apparatus includes a rectifier for rectifying an alternating current (AC) voltage to supply a ripple voltage, a light emitting unit partitioned into two or more groups, each of the groups including a plurality of LEDs, and a driving controller for selectively driving one or more of the groups of the light emitting unit depending on a level of the ripple voltage, the driving controller driving at least one of the groups of the light emitting unit using current discharged from a capacitor connected with the at least one group when the ripple voltage is lower than an operating voltage of the light emitting unit.

20 Claims, 21 Drawing Sheets

LIGHT EMITTING DIODE DRIVING APPARATUS

This application claims the benefit of Korean Patent Application No. 10-2012-0035540, filed on Apr. 5, 2012, which is hereby incorporated by reference as if fully set forth herein.

BACKGROUND OF THE DISCLOSURE

1. Field of the Disclosure

The present invention relates to a light emitting diode driving apparatus, and more particularly, to a light emitting diode driving apparatus which is capable of successively driving light emitting diodes.

2. Discussion of the Related Art

Research is in progress for light sources, light emitting methods, driving methods, etc. for lighting devices, and attention has recently been paid to a light emitting diode (LED) as such a light source in that it is advantageous to efficiency, color diversity, design autonomy, etc.

An LED is a semiconductor device that emits light when a forward voltage is applied thereto, and has a long lifespan, low power consumption, and electrical, optical and physical characteristics appropriate to mass production.

For effective use of such an LED as a light source for a lighting device, there is a need for a driving system which is capable of driving the LED with commercial alternating current (AC) power.

SUMMARY OF THE DISCLOSURE

Accordingly, the present invention is directed to a light emitting diode driving apparatus that substantially obviates one or more problems due to limitations and disadvantages of the related art.

An object of the present invention is to provide a light emitting diode driving apparatus which is capable of successively driving light emitting diodes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a light emitting diode (LED) driving apparatus includes a rectifier for rectifying an alternating current (AC) voltage to supply a ripple voltage, a light emitting unit partitioned into two or more groups, each of the groups including a plurality of LEDs, and a driving controller for selectively driving one or more of the groups of the light emitting unit depending on a level of the ripple voltage, the driving controller driving at least one of the groups of the light emitting unit using current discharged from a capacitor connected with the at least one group when the ripple voltage is lower than an operating voltage of the light emitting unit.

In another aspect of the present invention, a light emitting diode (LED) driving apparatus includes a rectifier for rectifying an alternating current (AC) voltage to supply a ripple voltage, the rectifier having a first terminal and a second terminal, a light emitting unit partitioned into a plurality of groups, the group including a plurality of LEDs, the groups including at least two groups branched from the first terminal, and a driving controller for selectively driving one or more of the groups of the light emitting unit depending on a level of the ripple voltage, the driving controller driving at least one of the groups of the light emitting unit using current discharged from a capacitor connected with the at least one group when the ripple voltage is lower than an operating voltage of the light emitting unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 2A and 2B, FIGS. 3A and 3B, FIGS. 4A and 4B, FIGS. 5A and 5B, and FIGS. 6A and 6B illustrate circuit operations and waveforms of the apparatus of FIG. 1 based on the level of a ripple voltage when an AC voltage is 220V, in which:

FIGS. 2A and 2B illustrate a circuit operation and waveforms when the level of the ripple voltage is lowest, respectively;

FIGS. 3A and 3B illustrate a circuit operation and waveforms when the level of the ripple voltage is middle, respectively;

FIGS. 4A and 4B illustrate a circuit operation and waveforms when the level of the ripple voltage is highest, respectively;

FIGS. 5A and 5B illustrate a circuit operation and waveforms when the level of the ripple voltage is middle, respectively; and FIGS. 6A and 6B illustrate a circuit operation and waveforms when the level of the ripple voltage is middle, respectively; and FIGS. 7A and 7B, FIGS. 8A and 8B, FIGS. 9A and 9B, FIGS. 10A and 10B, and FIGS. 11A and 11B illustrate circuit operations and waveforms of the apparatus of FIG. 1 based on the level of the ripple voltage when the AC voltage is 198V, in which:

FIGS. 7A and 7B illustrate a circuit operation and waveforms when the level of the ripple voltage is lowest, respectively;

FIGS. 8A and 8B illustrate a circuit operation and waveforms when the level of the ripple voltage is middle, respectively;

FIGS. 9A and 9B illustrate a circuit operation and waveforms when the level of the ripple voltage is highest, respectively;

FIGS. 10A and 10B illustrate a circuit operation and waveforms when the level of the ripple voltage is middle, respectively; and FIGS. 11A and 11B illustrate a circuit operation and waveforms when the level of the ripple voltage is middle, respectively.

DESCRIPTION OF SPECIFIC EMBODIMENTS

Figure 1:
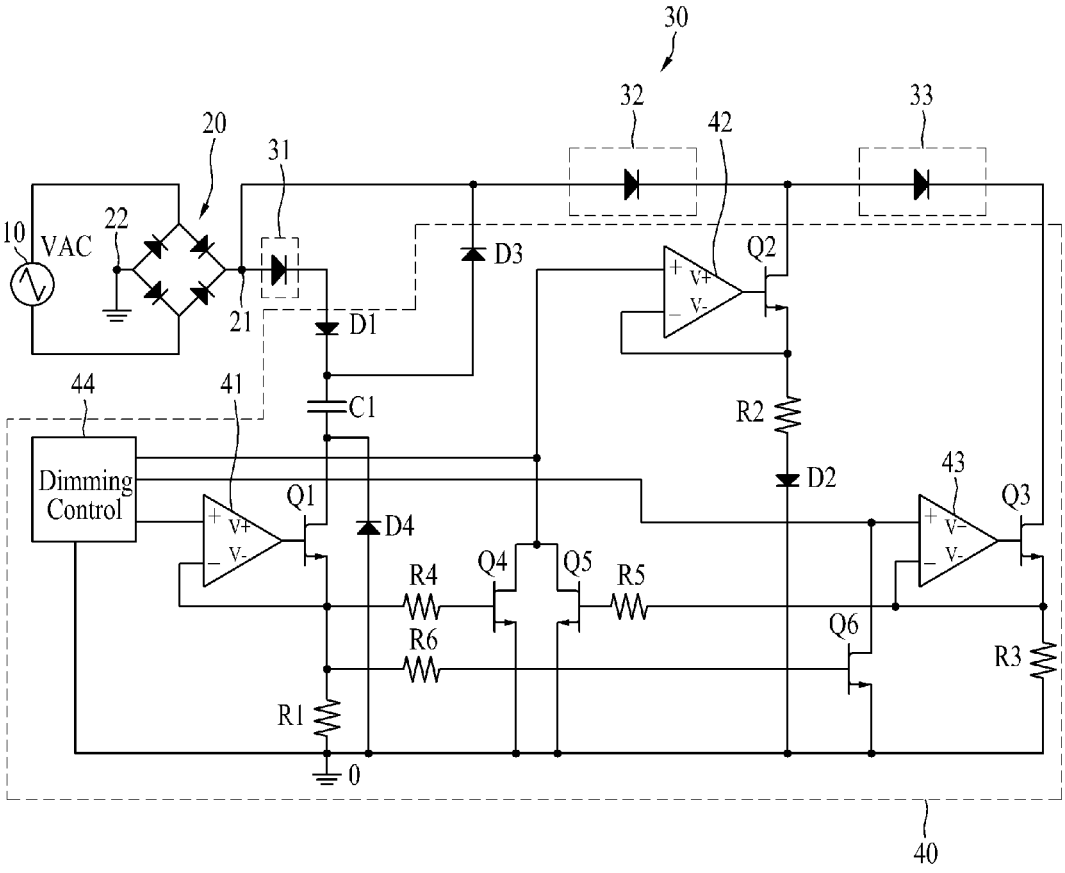
FIG. 1 is a circuit diagram showing an embodiment of a light emitting diode driving apparatus.

Reference will now be made in detail to the preferred embodiments of the present invention, examples of which are illustrated in the accompanying drawings. Wherever possible, the same reference numbers will be used throughout the drawings to refer to the same or like parts.

While the invention is susceptible to various modifications and alternative forms, specific embodiments thereof are shown by way of example in the drawings and will be described herein in detail. It should be understood, however, that there is no intent to limit the invention to the particular forms disclosed, but, on the contrary, the invention is to cover all modifications, equivalents, and alternatives falling within the spirit and scope of the invention as defined by the claims.

It will be understood that, when an element such as a layer, region or substrate is referred to as being "on" another element, it can be directly on the other element or intervening elements may also be present.

It will be understood that, although terms 'first', 'second', etc. may be used herein to describe various elements, components, regions, layers and/or sections, these elements, components, regions, layers and/or sections should not be limited by those terms.

FIG. 1 is a circuit diagram showing an embodiment of a light emitting diode (LED) driving apparatus. As shown in FIG. 1, the LED driving apparatus includes a rectifier 20 for rectifying an AC voltage from an AC voltage source 10 to output a ripple voltage.

The LED driving apparatus further includes a light emitting unit 30 which is driven by the ripple voltage. The light emitting unit 30 is partitioned into two or more groups 31, 32 and 33, each of which includes a plurality of LEDs connected in series.

In FIG. 1, the light emitting unit 30 is shown as including three groups. That is, the light emitting unit 30 is shown to include a first group Group 1 31, a second group Group 2 32, and a third group Group 3. Alternatively, the light emitting unit 30 may include two groups or four or more groups.

A driving controller 40 is also provided in the LED driving apparatus to selectively drive one or more of the groups of the light emitting unit 30 depending on the level of the output voltage from the rectifier 20.

In the case where the ripple voltage is lower than an operating voltage of the light emitting unit 30, the driving controller 40 drives at least one of the groups of the light emitting unit 30 using current discharged from a capacitor C1 connected with the at least one group.

Therefore, in driving the light emitting unit 30 including such a plurality of groups 31, 32 and 33, even in the case where the ripple voltage is lower than an operating voltage of any one of the groups of the light emitting unit 30, the one group may be driven by the discharged current from the capacitor C1, so that the light emitting unit 30 may be successively driven with no discontinuous light emission duration.

The driving controller 40 also controls the capacitor C1 to charge it in a phase state including a peak portion of the ripple voltage.

The first group 31 of the light emitting unit 30 is disposed between a first terminal 21 of the rectifier 20 and the capacitor C1, and at least one LED belonging to the first group 31 may emit light in a path along which the capacitor C1 is charged.

Also, the second group 32 of the light emitting unit is disposed in a path along which the capacitor C1 is discharged, and the third group 33 of the light emitting unit 30 is further disposed between the second group 32 and a second terminal (ground) 22 of the rectifier 20.

In this manner, the first group 31 and second group 32 of the light emitting unit 30 are branched from the first terminal 21. As a result, the first group 31 and the second group 32 may selectively emit light.

By virtue of this configuration, the driving controller 40 may control the second group 32 and the third group 33 such that at least one of the second group 32 and third group 33 is driven by the discharged current from the capacitor C1.

That is, the driving controller 40 may drive only the second group 32 or both the second group 32 and third group 33 with the discharged current from the capacitor C1 depending on the level of the ripple voltage.

Because the capacitor C1 is connected with the first group 31 as stated above, the driving controller 40 may also control the first group 31 such that the first group 31 emits light in the phase state including the peak portion of the ripple voltage.

At this time, the voltage of the capacitor C1 may be controlled in such a manner that it does not exceed a value obtained from subtraction of an operating voltage of the first group 31 from a peak level of the ripple voltage. The capacitor C1 may be an electrolytic capacitor. In this manner, the charged and discharged voltages or charges of the capacitor C1 may be controlled to be kept lower than the maximum capacity of the capacitor C1, so that the capacitor C1 may not be limited in lifespan.

In other words, a capacitor in which the maximum allowable voltages are periodically charged and discharged, such as a smoothing capacitor, may have a short lifespan. However, the charged and discharged voltages of the capacitor employed in the present embodiment shown in FIG. 1 may be controlled within a range much lower than the maximum allowable charged and discharged voltages of the capacitor, thereby significantly improving the lifespan of the capacitor. Actually, the lifespan of the driving circuit shown in FIG. 1 is little influenced by the lifespan of the capacitor.

On the other hand, the driving controller 40 includes one or more switches Q1, Q2 and Q3 for controlling the flow of currents to selectively drive one or more of the first group 31, second group 32 and third group 33 of the light emitting unit 30.

In FIG. 1, three switches Q1, Q2 and Q3 are shown to be configured to control the flow of currents to three groups 31, 32 and 33. That is, these switches include a first switch Q1 for allowing current to flow through the first group 31 and capacitor C1, a second switch Q2 for allowing current to flow through the second group 32, and a third switch Q3 for allowing current to flow through the second group 32 and third group 33.

Switch controllers 41, 42 and 43 are also provided to control the switches Q1, Q2 and Q3, respectively. Transistors Q4, Q5 and Q6 and resistors R1, R2, R3, R4, R5 and R6 are connected among the first, second and third switch controllers 41, 42 and 43 to control on/off of the switches Q1, Q2 and Q3 relatively.

That is, in the case where current flows through the first group 31 owing to conduction of the first switch Q1, it is detected by the resistor R1 and then applied to the second switch controller 42 through the resistor R4 and transistor Q4, thereby causing the second switch Q2 to be turned off. Also, the detected current is applied to the third switch controller 43 through the resistor R6 and transistor Q6, thereby causing the third switch Q3 to be turned off.

In the case where the discharged current from the capacitor C1 flows through the second group 32 and third group 33 owing to conduction of the third switch Q3, it is detected by the resistor R3 and then applied to the second switch controller 42 through the resistor R5 and transistor Q5, thereby causing the second switch Q2 to be turned off.

On the other hand, a dimming controller 44 may be provided to control brightness of the light emitting unit 30. The dimming controller 44 is in common connected with the switch controllers 41, 42 and 43 to apply a reference voltage (control voltage) for dimming to the switch controllers 41, 42 and 43. The dimming reference voltage is also controlled by the switches Q1, Q2 and Q3 or transistors Q4, Q5 and Q6 to control a dimming operation.

As described above, in the LED driving apparatus which is driven directly by the AC voltage, the LEDs may be successively driven with no discontinuous light emission duration, thereby improving a blinking phenomenon.

This successive driving may be carried out by providing the capacitor C1 and charging the capacitor C1 to a voltage higher than a driving voltage (operating voltage) Vf of the first group 31 of the light emitting unit 30. Also, the control voltage of the dimming controller 44 is controlled depending on an input voltage so that a constant output may be provided.

Also, the charged and discharged voltages or charges of the capacitor C1 may be controlled to be kept lower than the maximum capacity of the capacitor C1, so that the capacitor C1 may not be limited in lifespan.

Moreover, the switch controllers 41, 42 and 43 are controlled in common by the reference voltage from the dimming controller 44, thereby simplifying the circuit configuration.

Hereinafter, a detailed description will be given of the operation of the circuit of FIG. 1 with time.

First, a description will be given in connection with an example in which the AC input voltage is 220V. In this case, it is premised that the capacitor C1 is charged by initial driving to a voltage capable of driving at least one of the second group 32 and third group 33.

Figure 2A:
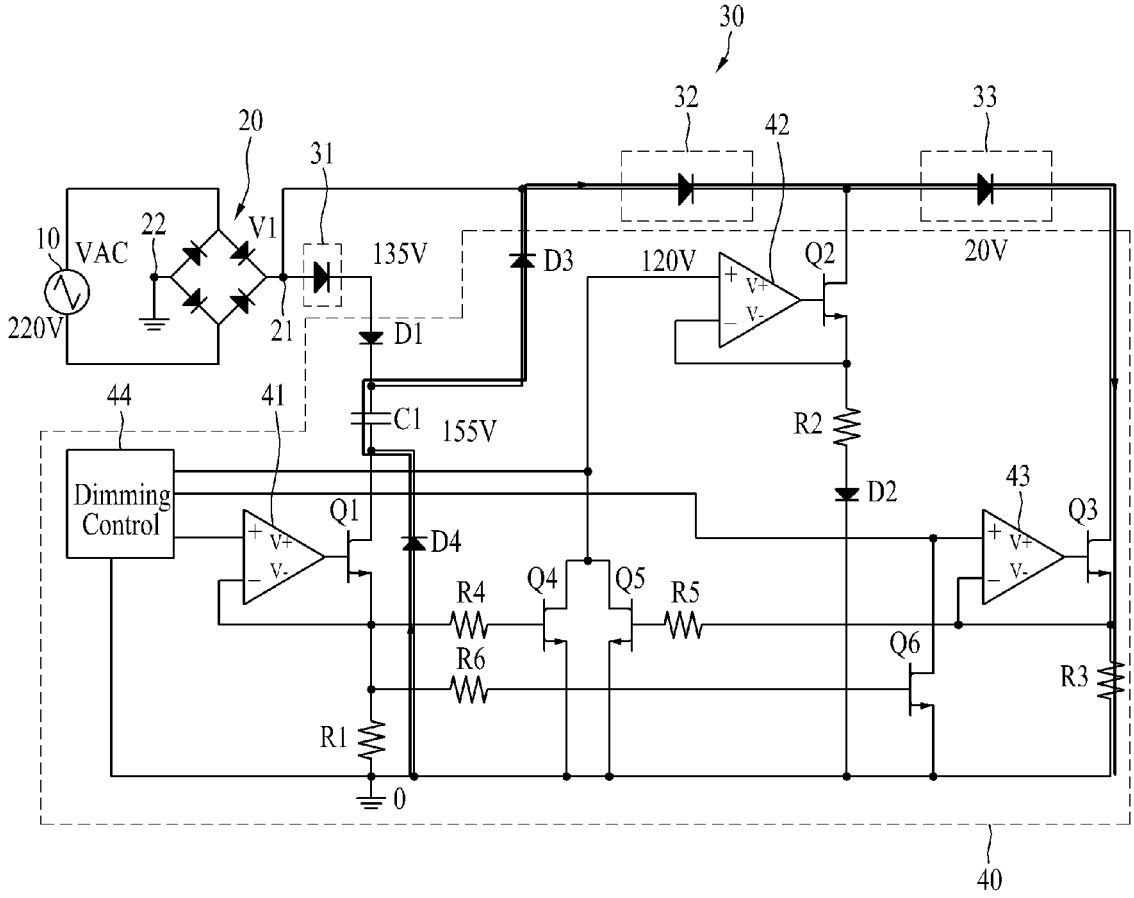
Figure 2B:
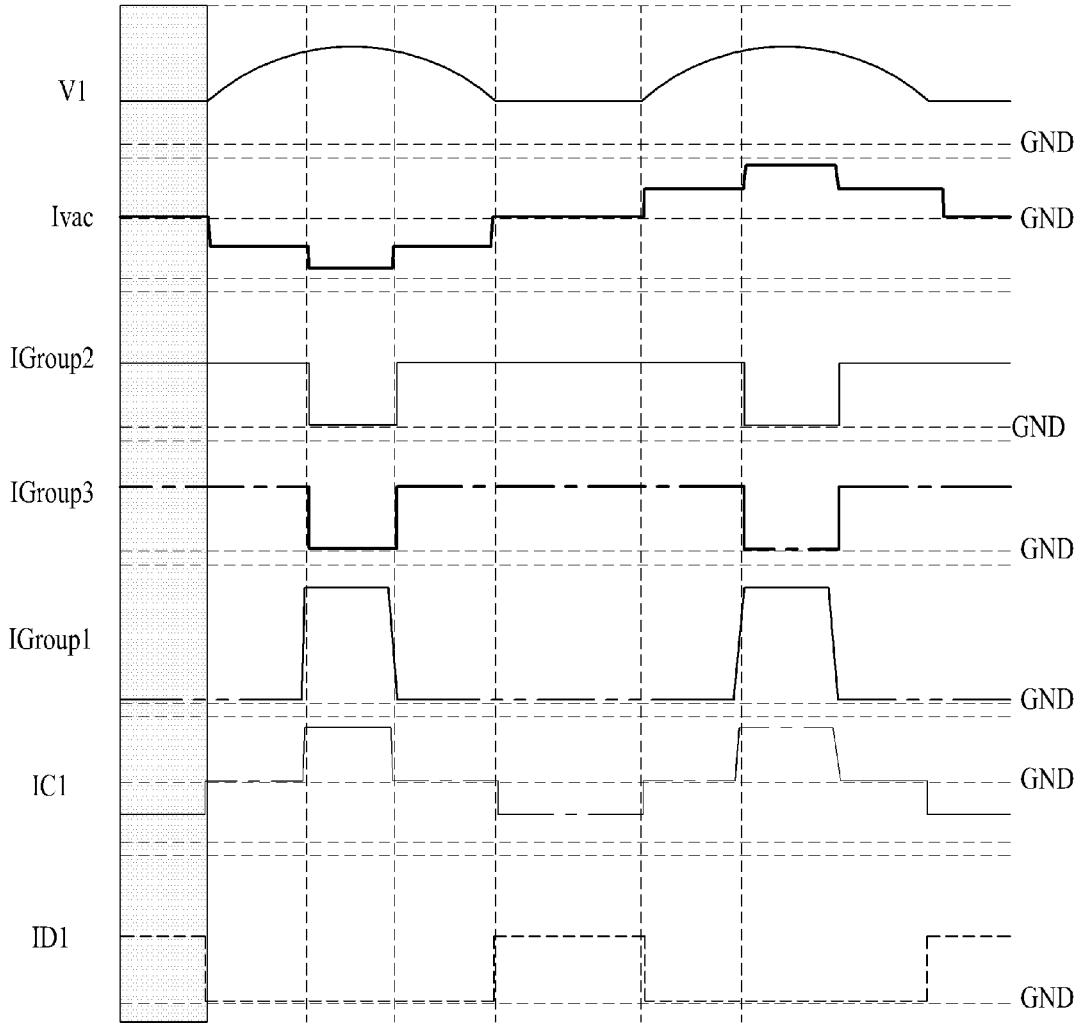

Referring to FIGS. 2A and 2B, in the case where the level of the ripple voltage V1 is low, current flows through a diode D4 under the condition that the third switch Q3 is turned on, and current charged in the capacitor C1 then flows through a diode D3 to drive the second group (Group 2) 32 and the third group (Group 3) 33.

Accordingly, in the case where the ripple voltage V1 is lower than the driving voltage of the first group Group 1 31, the second group 32 and the third group 33 may emit light.

At this time, the capacitor C1 is substantially charged to a voltage obtained from subtraction of the operating voltage of the first group 31, an operating voltage of the first switch Q1 and a voltage across the resistor R1 from a peak level (310V) of the ripple voltage. The charged voltage is sufficiently higher than operating voltages of the second group 32 and third group 33, thereby causing the same current to flow through the second group 32 and the third group 33.

For example, the operating voltage of the first group 31 may be 135V, and the voltage of the capacitor C1 may be 155V which is higher than the sum of the operating voltage 120V of the second group 32 and the operating voltage 20V of the third group 33. In this case, it will be understood that a smaller number of LEDs may be provided in the third group 33.

Figure 3A:
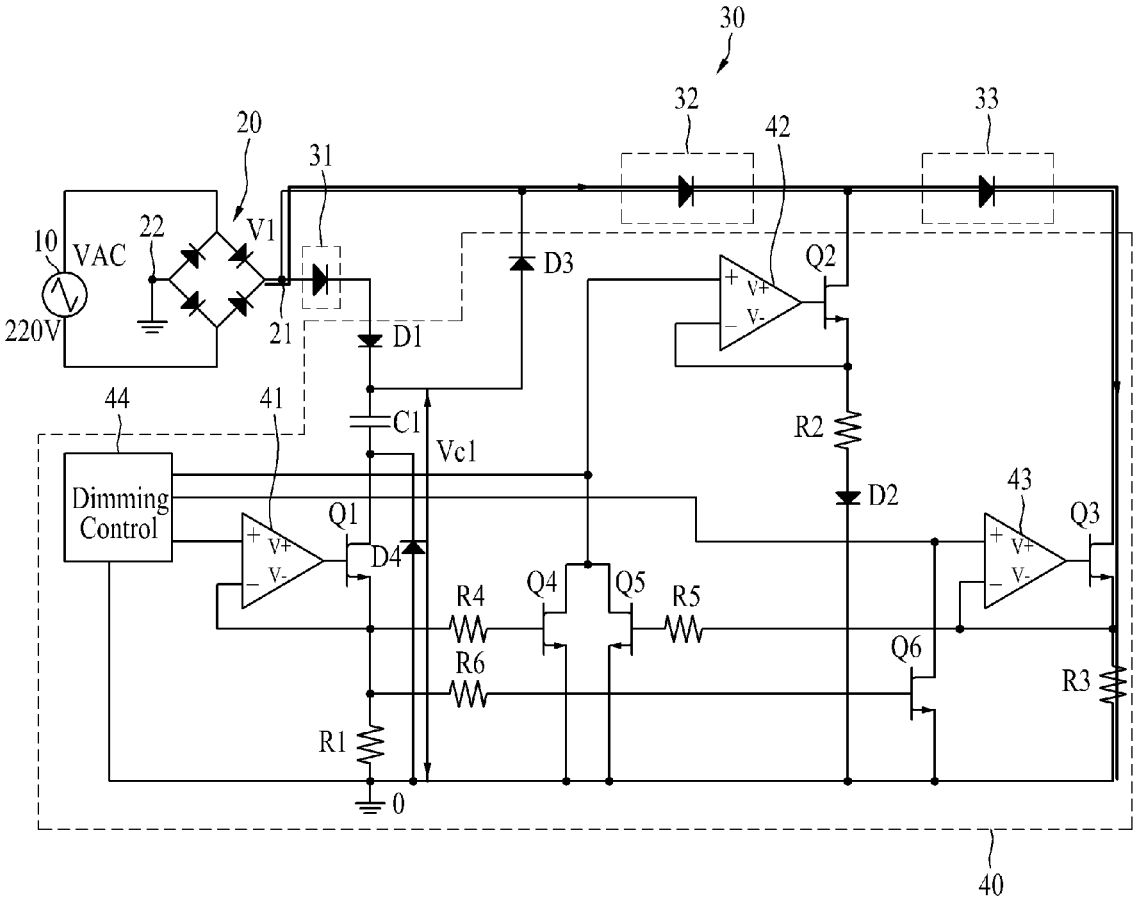
Figure 3B:
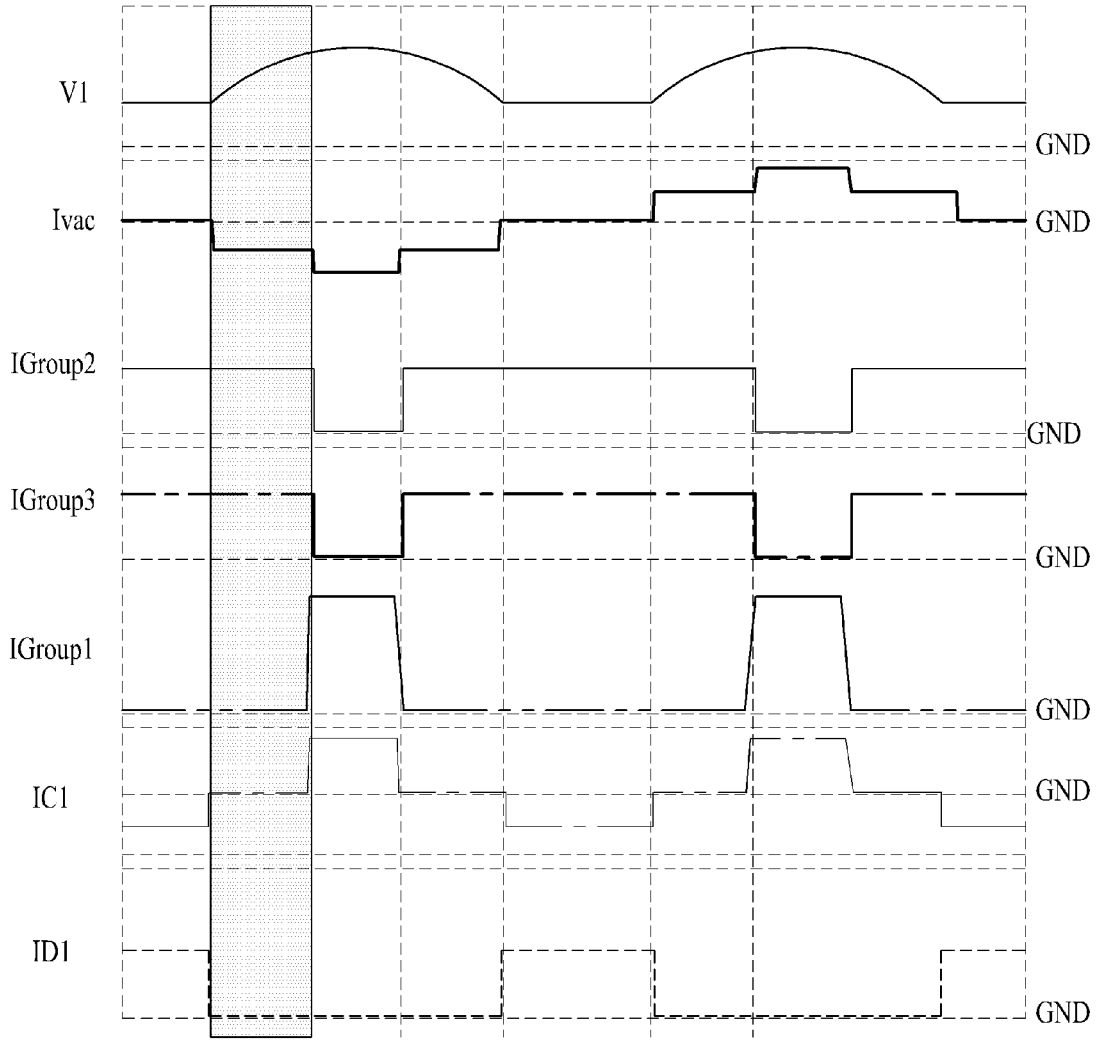

Next, when the level of the ripple voltage V1 becomes high, the second group 32 and the third group 33 may emit light by the ripple voltage V1 under the condition that the third switch Q3 is turned on, as shown in FIGS. 3A and 3B.

In this case, the peak level of the ripple voltage V1 may be lower than a value obtained from addition of the voltage Vc1 of the capacitor C1 to the operating voltage of the first group 31 and higher than the operating voltages of the second group 32 and third group 33.

Figure 4A:
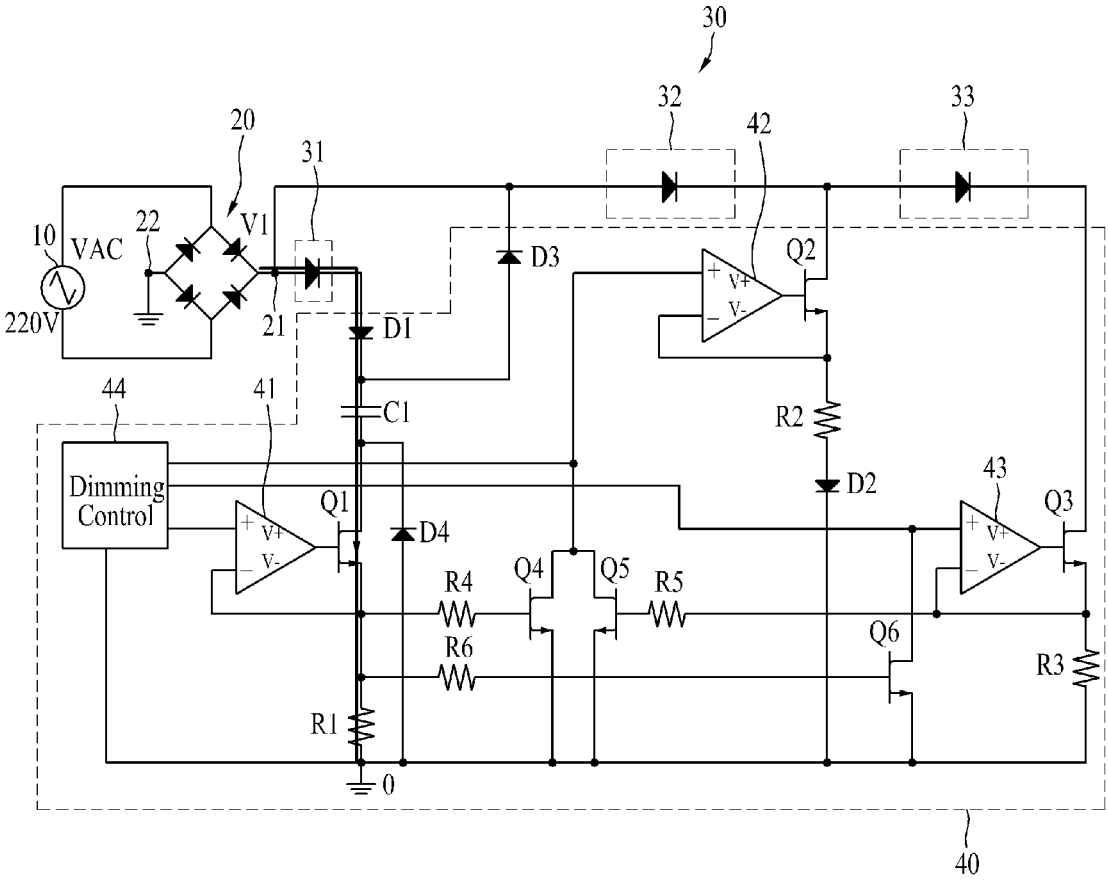
Figure 4B:
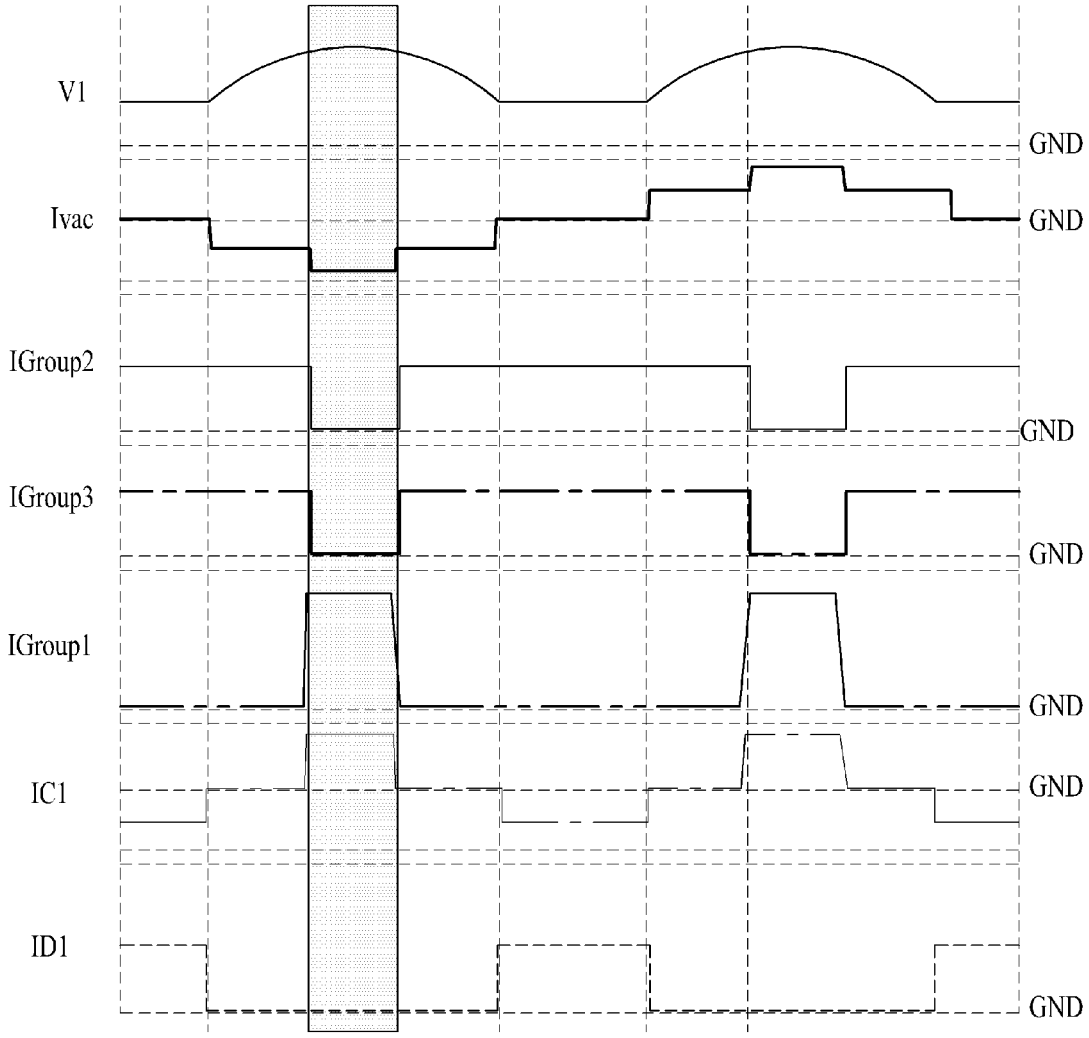

Thereafter, when the level of the ripple voltage V1 becomes higher, at least one LED belonging to the first group 31 may be turned on under the condition that the first switch Q1 is turned on, as shown in FIGS. 4A and 4B.

In this case, the peak level of the ripple voltage V1 may be higher than a value obtained from addition of the voltage Vc1 of the capacitor C1 to the operating voltage of the first group 31. That is, this phase state may include the peak portion of the ripple voltage V1. In this case, a process of charging the capacitor C1 may be carried out.

Figure 5A:
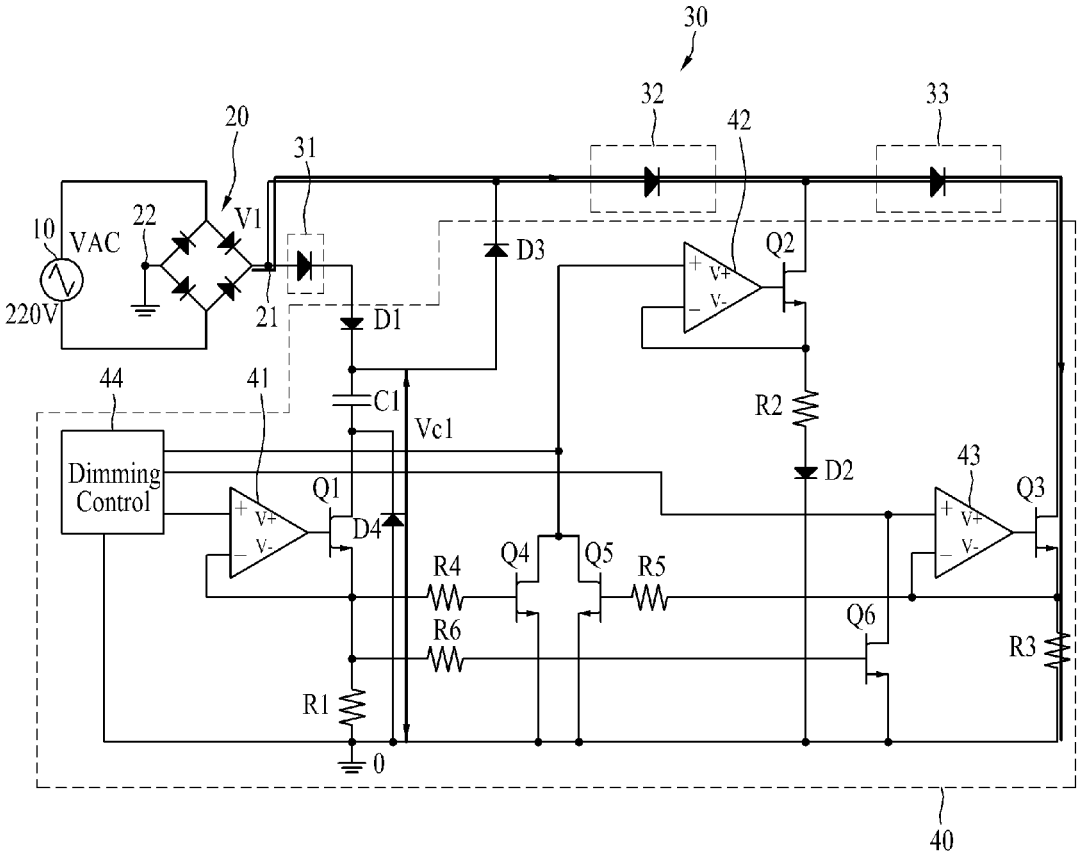
Figure 5B:
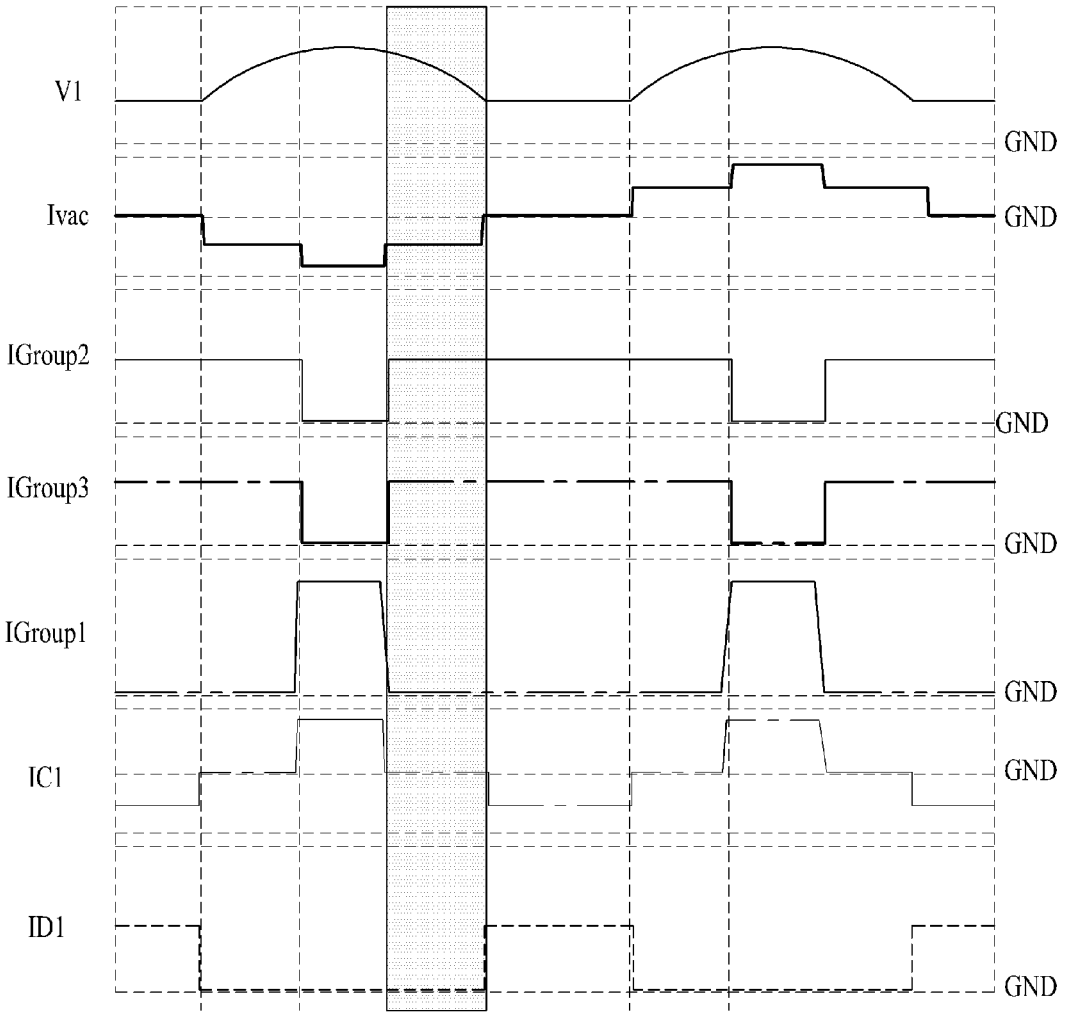
Figure 6A:
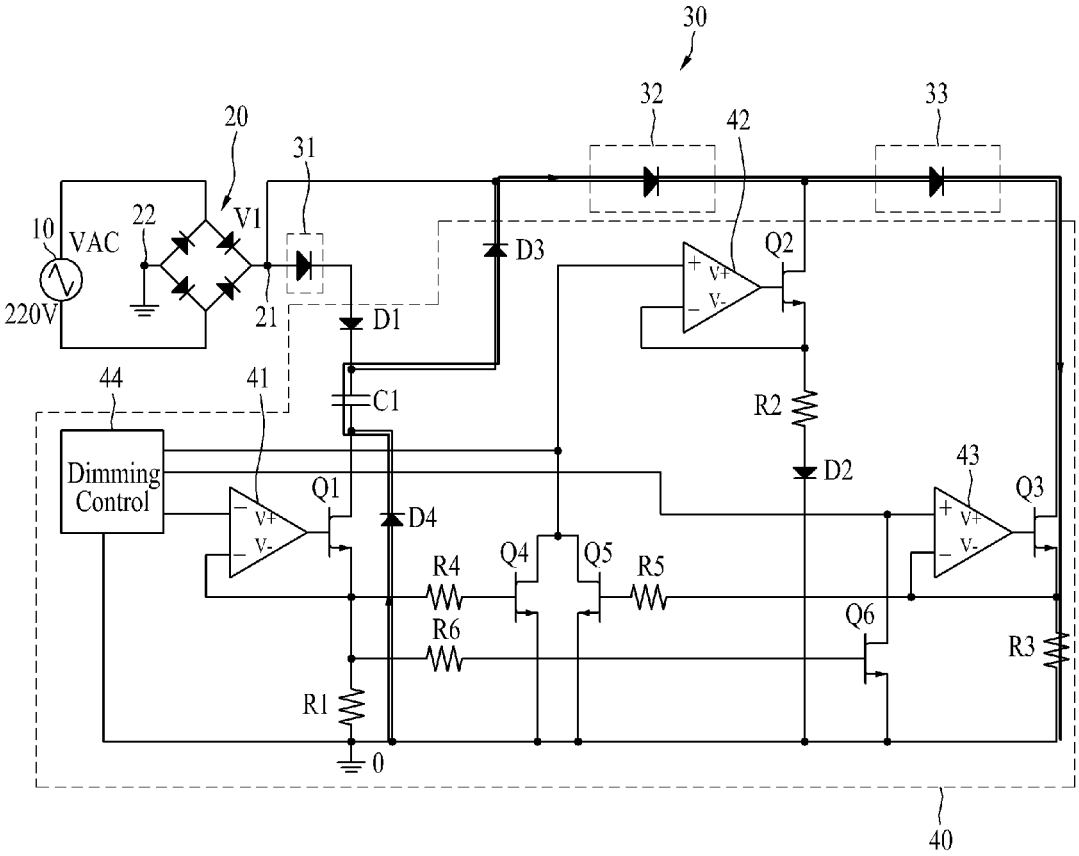
Figure 6B:
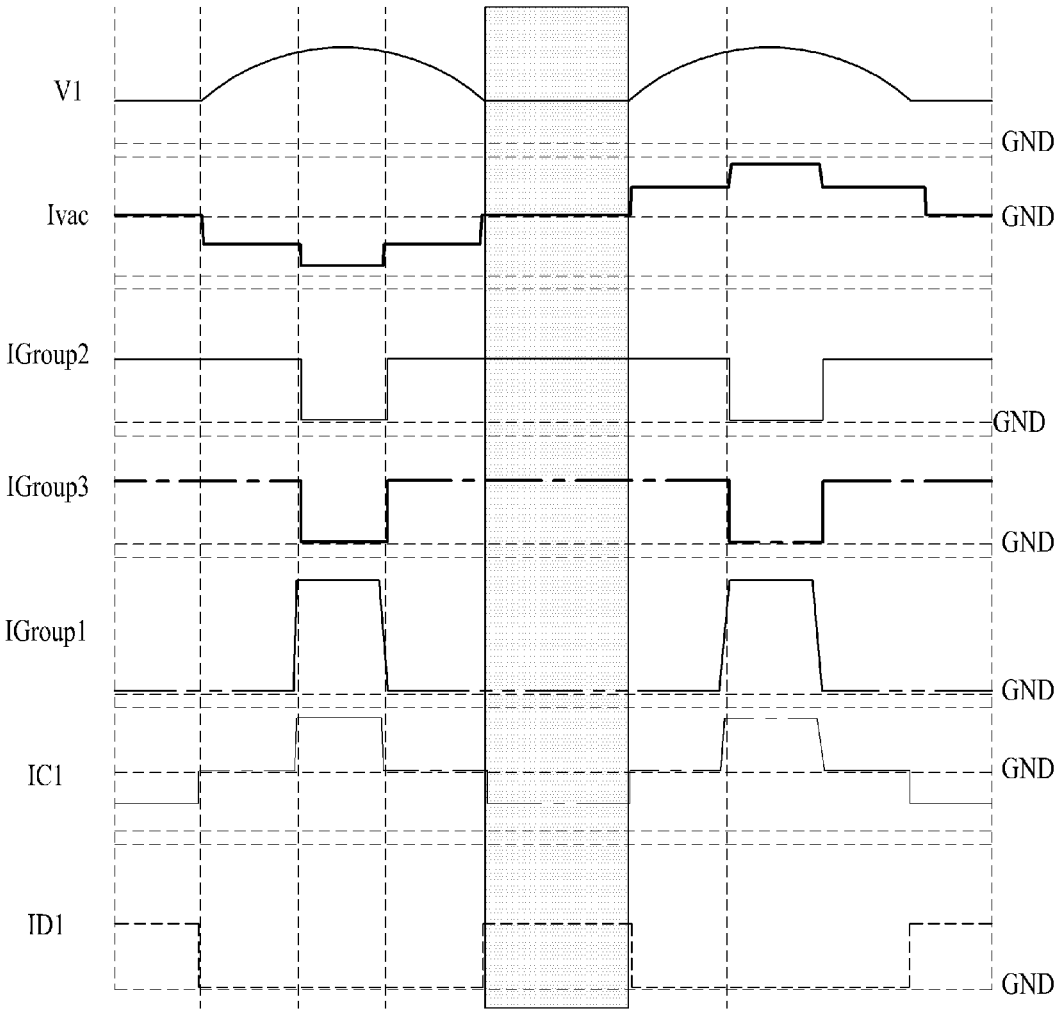

Next, when the level of the ripple voltage V1 becomes low again, the second group 32 and the third group 33 may emit light by the ripple voltage V1 under the condition that the third switch Q3 is turned on, as shown in FIGS. 5A and 5B.

In this case, the peak level of the ripple voltage V1 may be lower than a value obtained from addition of the voltage Vc1 of the capacitor C1 to the operating voltage of the first group 31 and higher than the operating voltages of the second group 32 and third group 33. The circuit operation is performed in the same manner as that in FIGS. 3A and 3B.

Thereafter, when the ripple voltage V1 becomes lower than the driving voltage of the first group (Group 1) 31, current is supplied from the capacitor C1, so that the second group 32 and the third group 33 may emit light.

That is, under the condition that the third switch Q3 is turned on, current flows through the diode D4 and current charged in the capacitor C1 then flows through the diode D3 to drive the second group (Group 2) 32 and the third group (Group) 3 33.

Therefore, even in the case where the ripple voltage V1 is lower than a voltage capable of driving the light emitting unit 30, at least one LED belonging to at least the first group 31 may be turned on, so that the light emitting unit 30 may be successively driven with no discontinuous light emission duration.

Next, a description will be given in connection with an example in which the AC input voltage is 198V. In this case, it is premised that the capacitor C1 is charged by initial driving to a voltage capable of driving the second group 32.

Figure 7A:
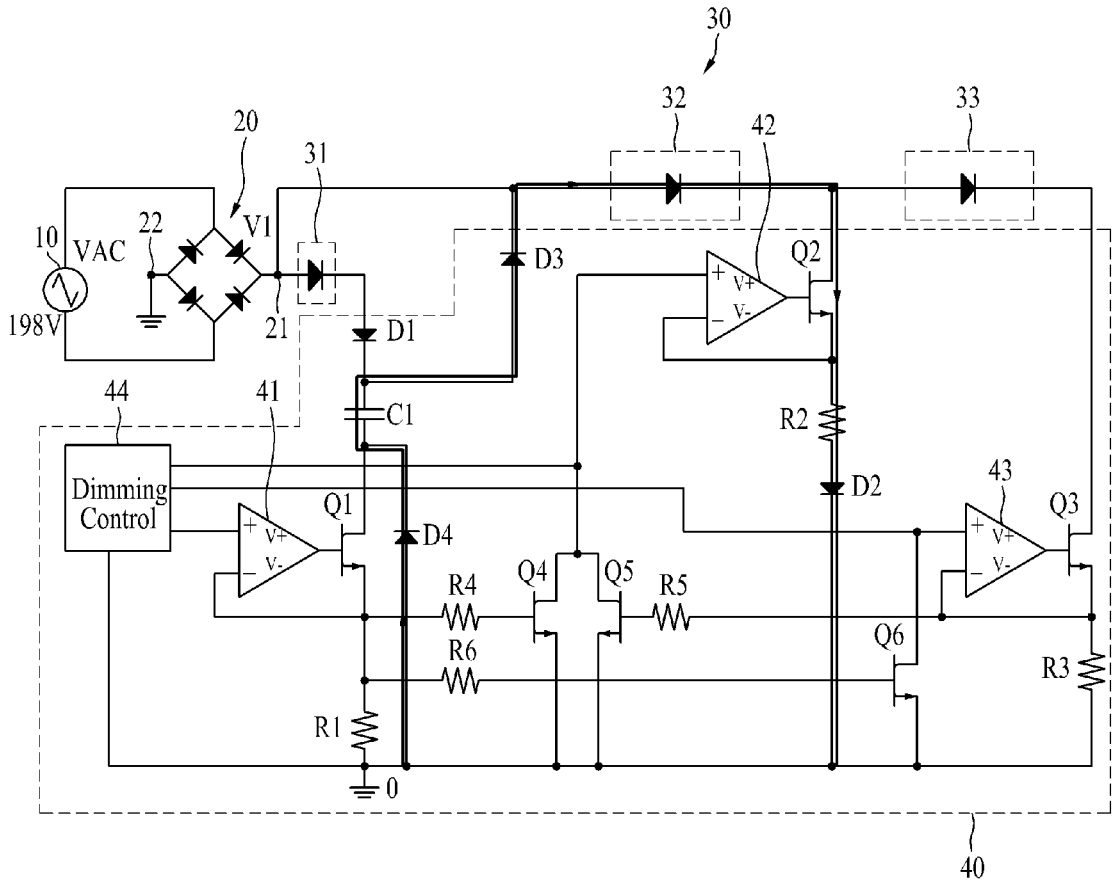
Figure 7B:
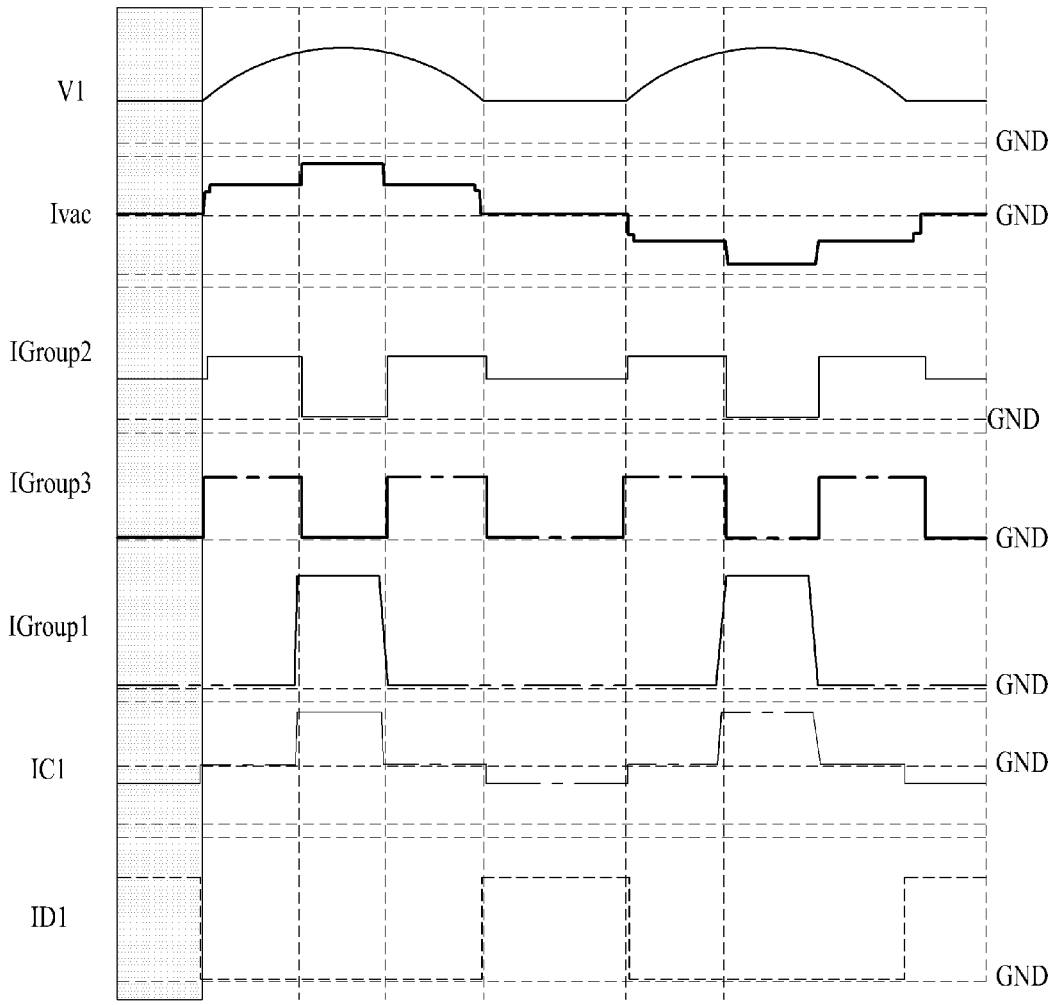

Referring to FIGS. 7A and 7B, in the case where the level of the ripple voltage V1 is low, the voltage of the capacitor C1 is not higher than the sum of the operating voltages of the second group 32 and third group 33 and is higher than the operating voltage of the first group 31, thereby causing no current to flow to the third switch Q3.

As a result, the second switch Q2 is turned on, current flows through the diode D4, and current charged in the capacitor C1 then flows through the diode D3 to drive the second group (Group 2) 32.

At this time, the capacitor C1 is substantially charged to a voltage obtained from subtraction of the operating voltage of the first group 31, the operating voltage of the first switch Q1 and the voltage across the resistor R1 from the peak level of the ripple voltage. The charged voltage is not higher than the sum of the operating voltages of the second group 32 and third group 33, thereby causing different currents to flow through the second group 32 and the third group 33.

For example, the operating voltage of the first group 31 may be 135V, and the voltage of the capacitor C1 may be 133V which is not higher than the sum of the operating voltage 120V of the second group 32 and the operating voltage 20V of the third group 33.

Figure 8A:
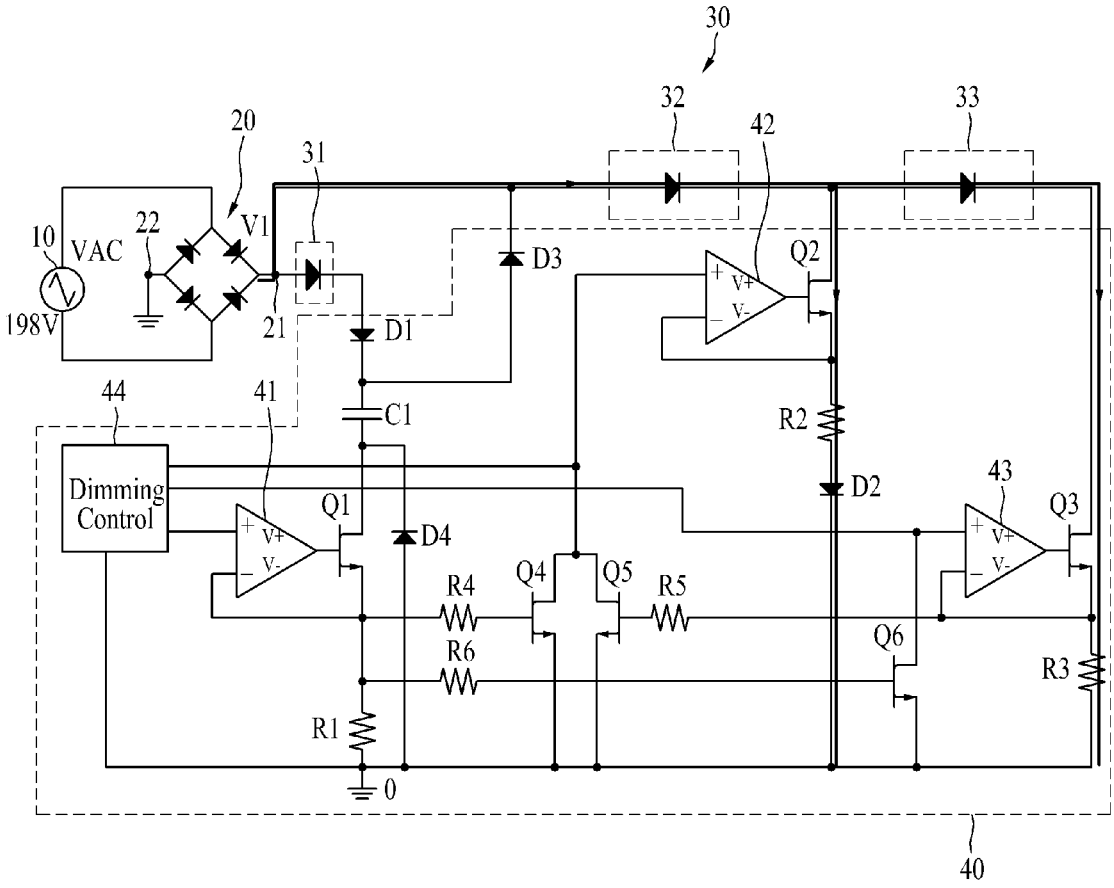
Figure 8B:
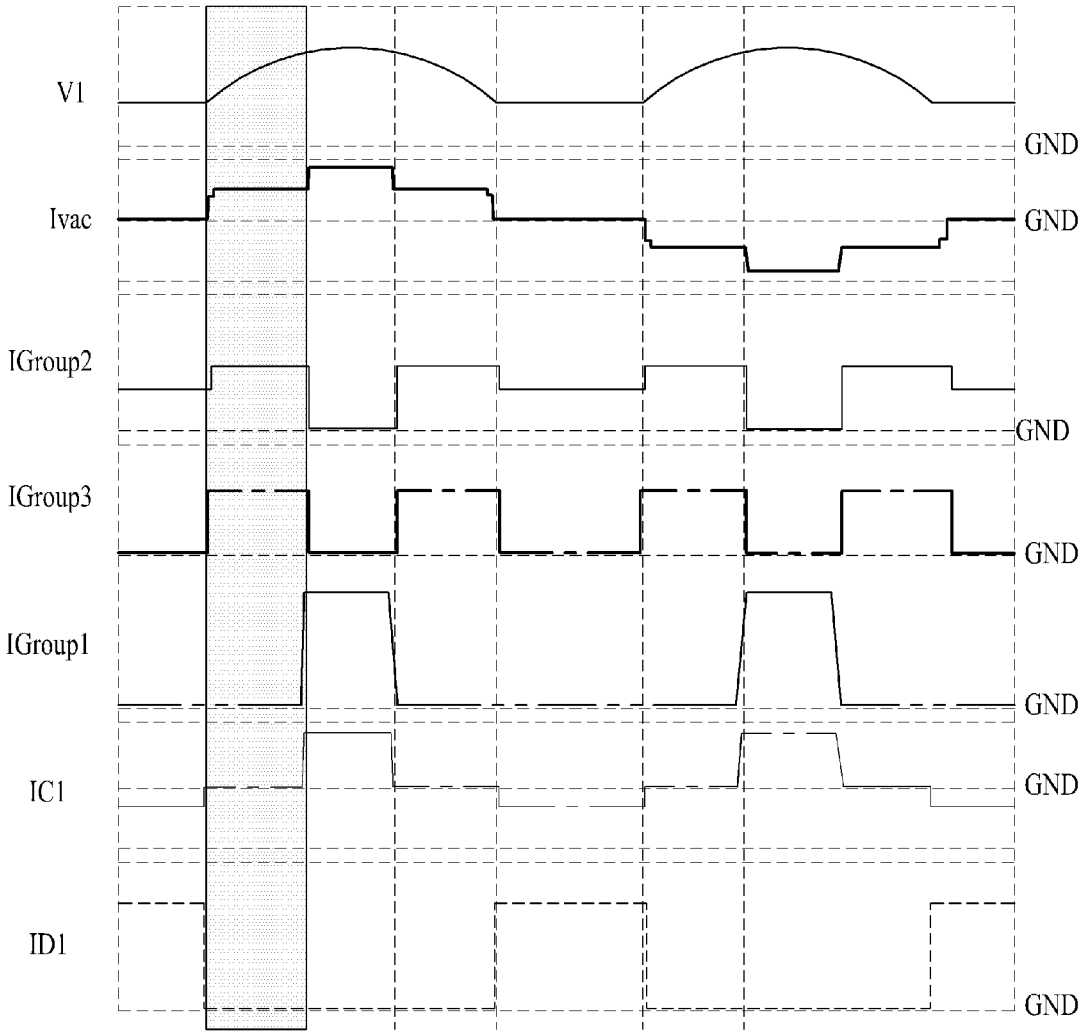

Next, when the level of the ripple voltage V1 becomes high, the second group 32 and the third group 33 may emit light by the ripple voltage V1 under the condition that the second switch Q2 and the third switch Q3 are turned on, as shown in FIGS. 8A and 8B.

In this case, the peak level of the ripple voltage V1 may be lower than a value obtained from addition of the voltage Vc1 of the capacitor C1 to the operating voltage of the first group 31 and higher than the operating voltages of the second group 32 and third group 33.

Figure 9A:
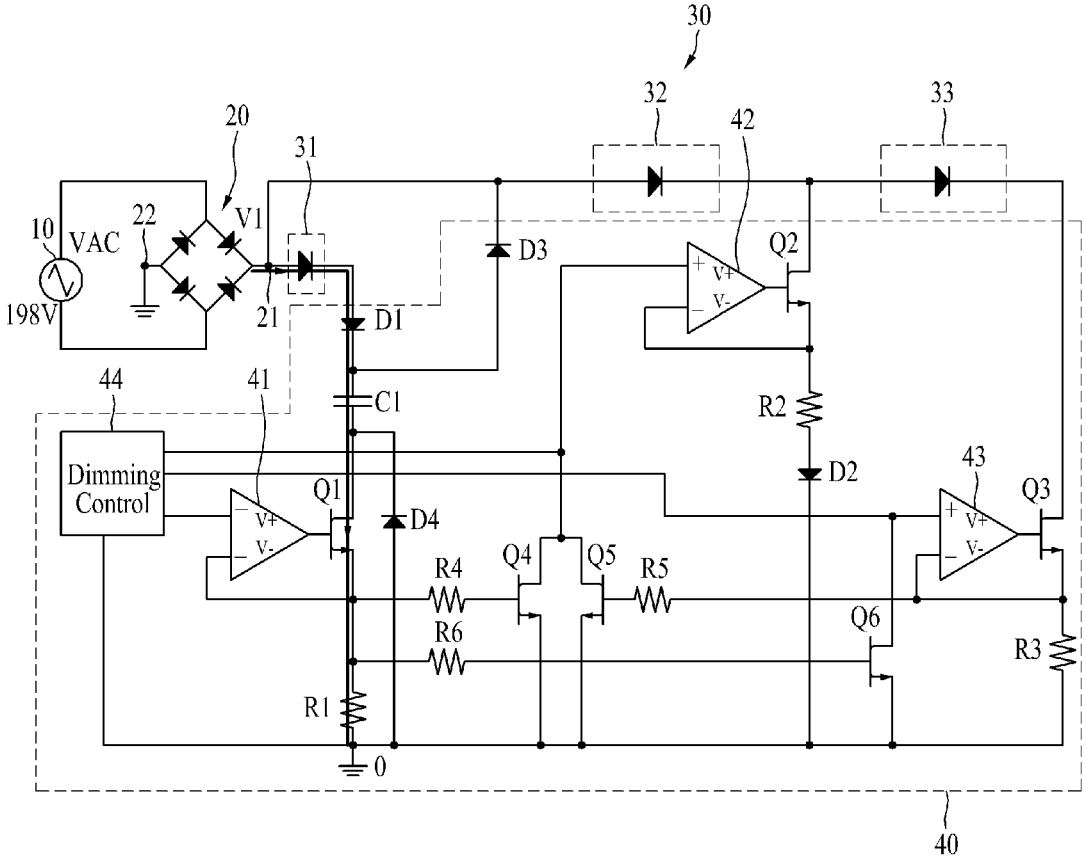
Figure 9B:
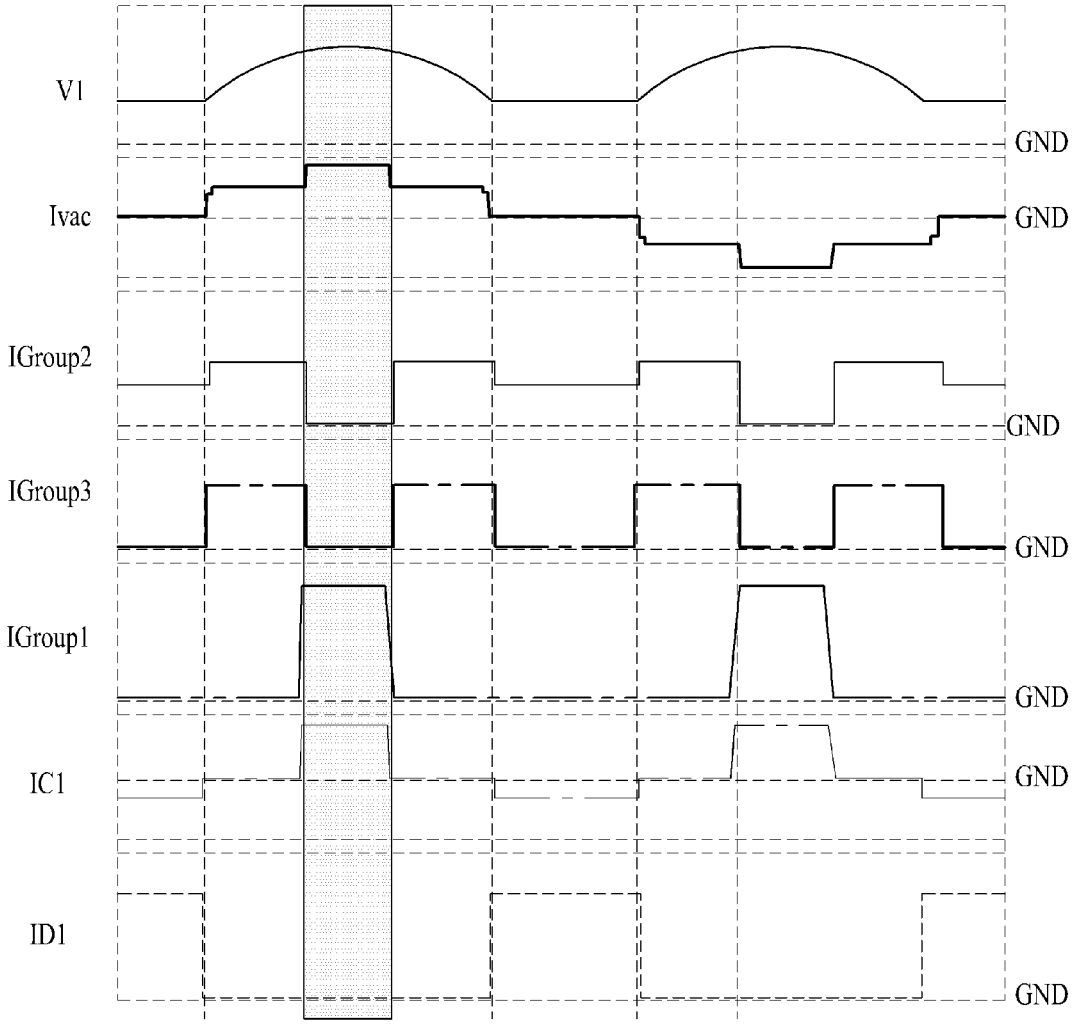

Thereafter, when the level of the ripple voltage V1 becomes higher, at least one LED belonging to the first group 31 may be turned on under the condition that the first switch Q1 is turned on, as shown in FIGS. 9A and 9B.

In this case, the peak level of the ripple voltage V1 may be higher than a value obtained from addition of the voltage Vc1 of the capacitor C1 to the operating voltage of the first group 31. That is, this phase state may include the peak portion of the ripple voltage V1. In this case, a process of charging the capacitor C1 may be carried out. This case is the same as that in the example in which the AC input voltage is 220V.

Figure 10A:
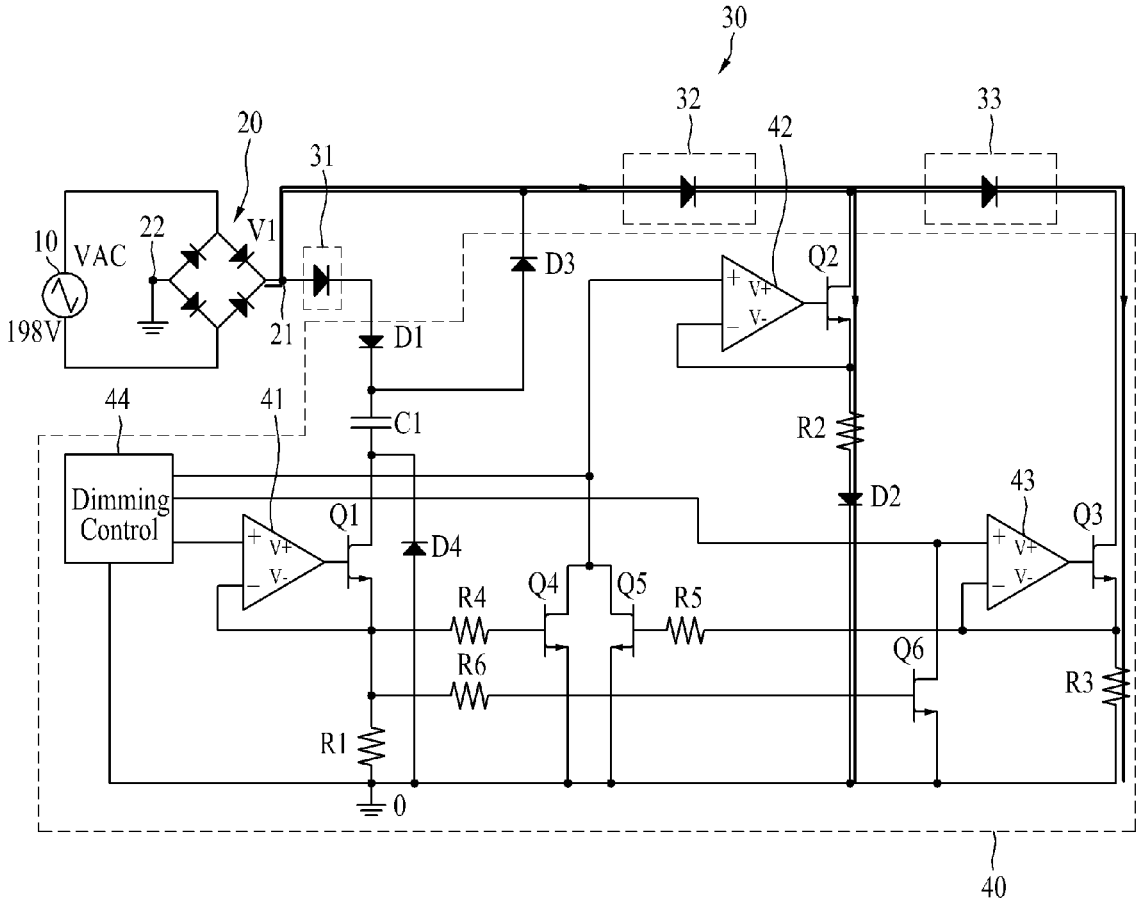
Figure 10B:
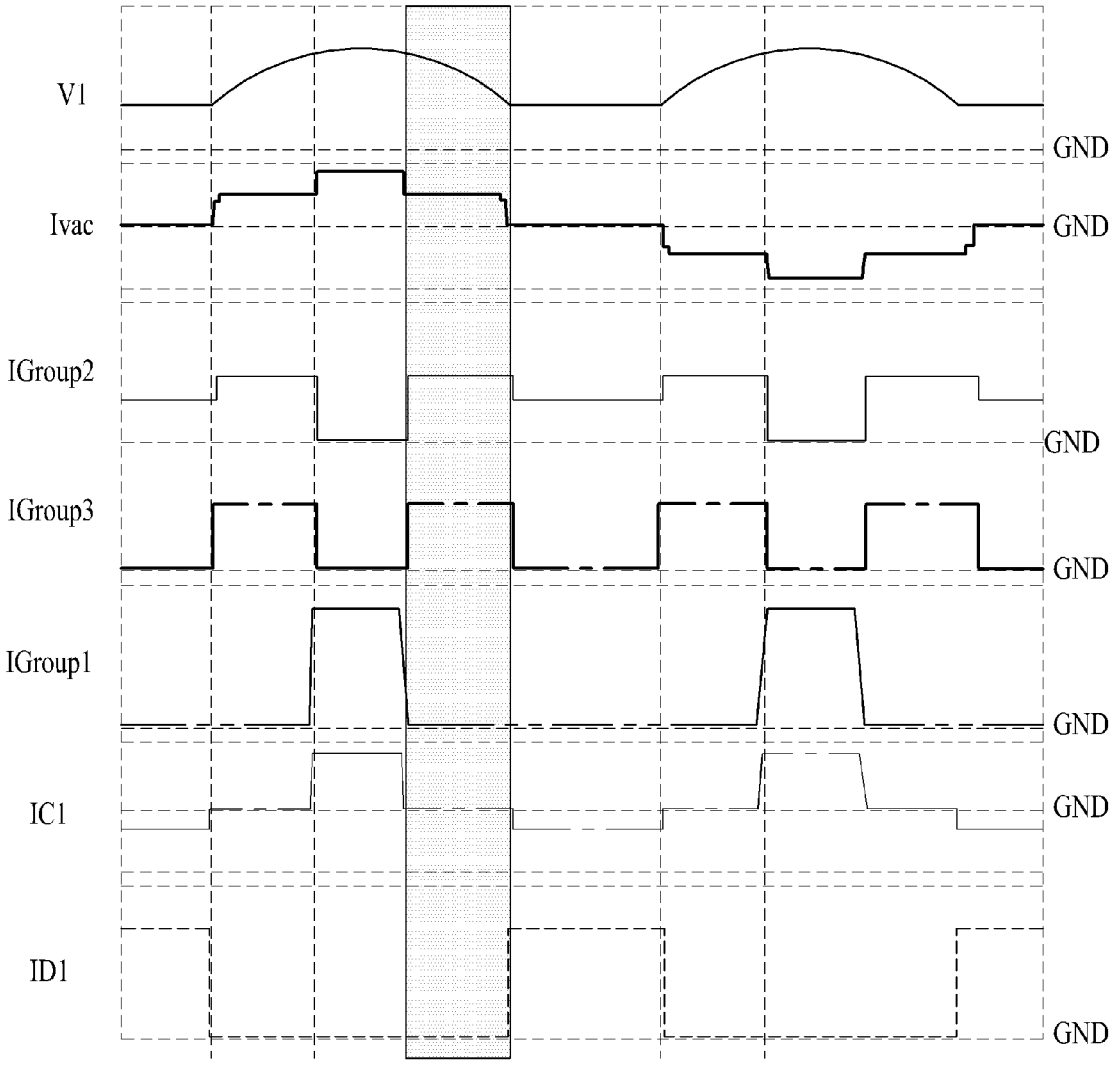
Figure 11A:
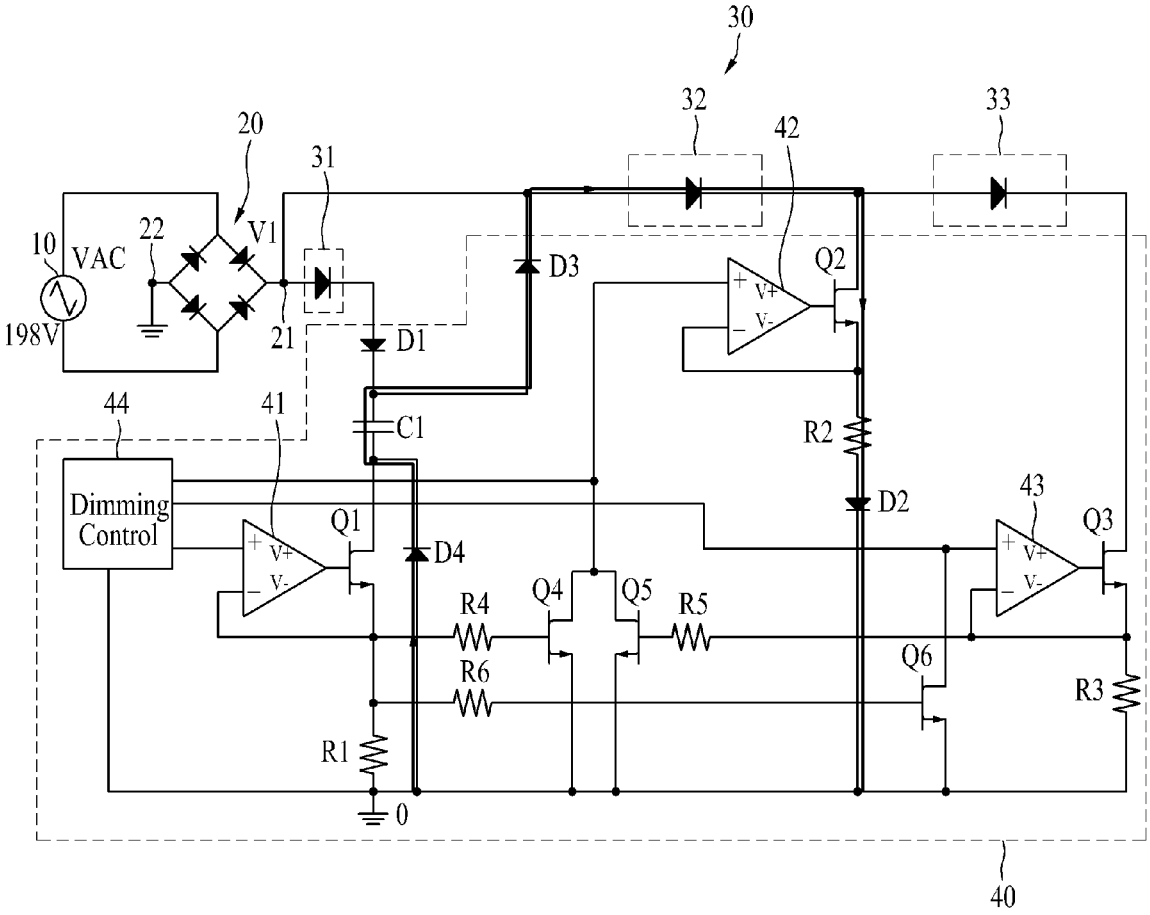
Figure 11B:
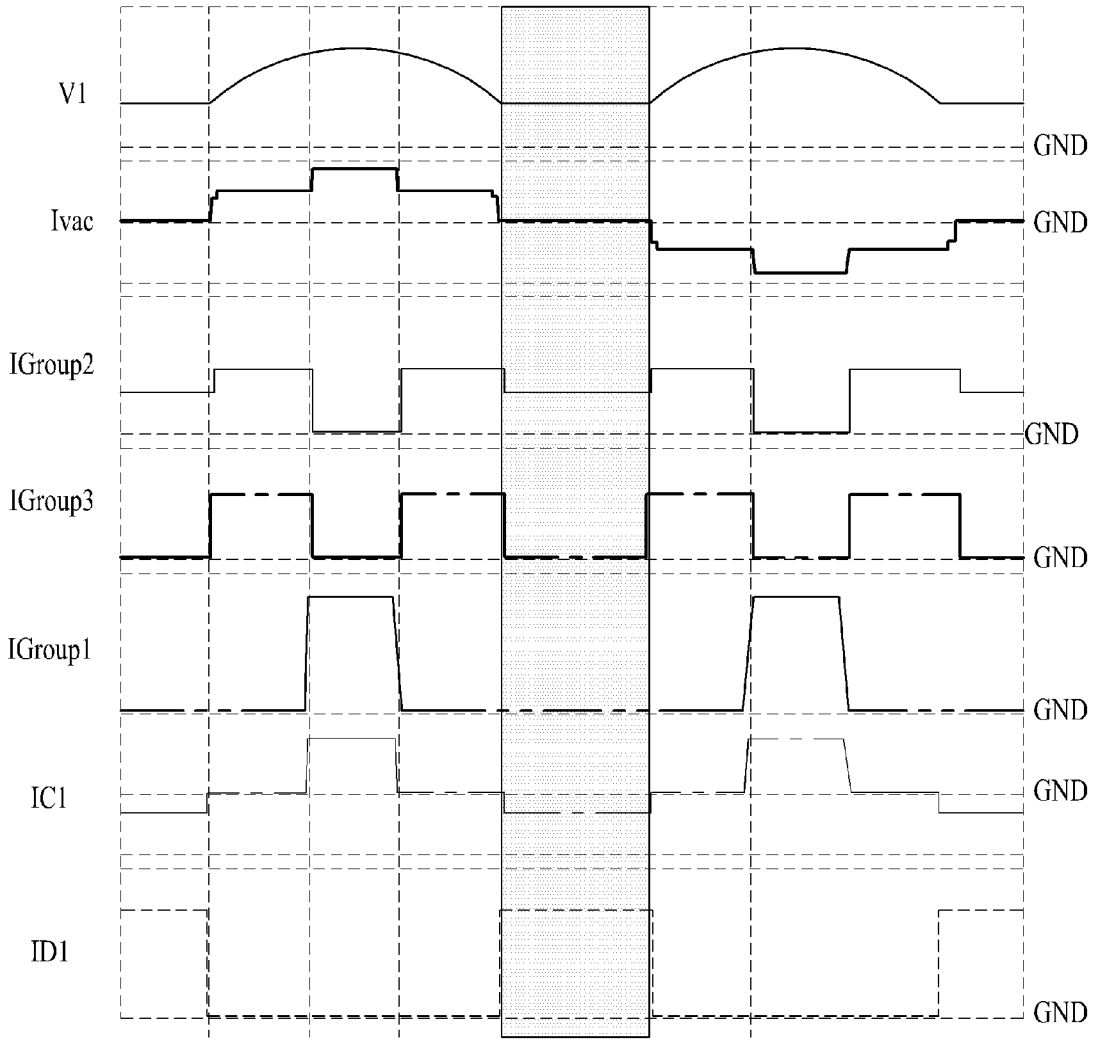

Next, when the level of the ripple voltage V1 becomes low again, the second group 32 and the third group 33 may emit light by the ripple voltage V1 under the condition that the second switch Q2 and the third switch Q3 are turned on, as shown in FIGS. 10A and 10B.

In this case, the peak level of the ripple voltage V1 may be lower than a value obtained from addition of the voltage Vc1 of the capacitor C1 to the operating voltage of the first group 31 and higher than the operating voltages of the second group 32 and third group 33. The circuit operation is performed in the same manner as that in FIGS. 8A and 8B.

Thereafter, when the ripple voltage V1 becomes lower than the driving voltage of the first group (Group 1) 31, current is supplied from the capacitor C1, so that the second group 32 may emit light.

At this time, the voltage of the capacitor C1 is not higher than the sum of the operating voltages of the second group 32 and third group 33 and is lower than the operating voltage of the second group 32, thereby causing no current to flow to the third switch Q3.

That is, in this case, under the condition that the second switch Q2 is turned on, current flows through the diode D4 and current charged in the capacitor C1 then flows through the diode D3 to drive the second group (Group 2) 32.

In this manner, even in the case where the ripple voltage V1 is lower than a voltage capable of driving the light emitting unit 30, at least one LED belonging to at least the first group 31 may be turned on, so that the light emitting unit may be successively driven with no discontinuous light emission duration.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting diode (LED) driving apparatus comprising:
   - a rectifier for rectifying an alternating current (AC) voltage to supply a ripple voltage;
   - a light emitting unit partitioned into two or more groups, each of the groups including a plurality of LEDs; and
   - a driving controller for selectively driving one or more of the groups of the light emitting unit depending on a level of the ripple voltage, the driving controller driving at least one of the groups of the light emitting unit using current discharged from a capacitor connected with the at least one group when the ripple voltage is lower than an operating voltage of the light emitting unit.

2. The LED driving apparatus according to claim 1, wherein the driving controller controls the capacitor to charge it in a phase state including a peak portion of the ripple voltage.

3. The LED driving apparatus according to claim 1, wherein the light emitting unit comprises:
   - a first group disposed between a first terminal of the rectifier and the capacitor; and
   - a second group connected to a discharge path of the capacitor.

4. The LED driving apparatus according to claim 3, wherein the light emitting unit further comprises a third group connected between the second group and a second terminal of the rectifier.

5. The LED driving apparatus according to claim 4, wherein the driving controller controls the second group and the third group such that at least one of the second group and third group is driven by the discharged current from the capacitor.

6. The LED driving apparatus according to claim 4, wherein the driving controller controls the second group and the third group depending on the level of the ripple voltage such that the second group or both the second group and third group are driven by the discharged current from the capacitor.

7. The LED driving apparatus according to claim 3, wherein the driving controller controls the first group such that the first group emits light in a phase state including a peak portion of the ripple voltage.

8. The LED driving apparatus according to claim 3, wherein the capacitor is charged to a voltage that does not exceed a value obtained from subtraction of an operating voltage of the first group from a peak level of the ripple voltage.

9. The LED driving apparatus according to claim 4, wherein the driving controller comprises:
   - one or more switches for controlling flow of currents to selectively drive one or more of the first group, second group and third group; and
   - a switch controller for controlling the switches.

10. The LED driving apparatus according to claim 9, wherein the switches comprise:
   - a first switch for allowing current to flow through the first group and capacitor;
   - a second switch for allowing current to flow through the second group; and
   - a third switch for allowing current to flow through the second group and third group.

11. The LED driving apparatus according to claim 1, further comprising a dimming controller for controlling brightness of the light emitting unit.

12. The LED driving apparatus according to claim 9, further comprising a dimming controller for controlling brightness of the light emitting unit, the dimming controller being connected to the switch controller.

13. The LED driving apparatus according to claim 1, wherein the driving controller controls a voltage charged in the capacitor within a voltage range lower than a maximum allowable charged voltage of the capacitor.

14. A light emitting diode (LED) driving apparatus comprising:
   - a rectifier for rectifying an alternating current (AC) voltage to supply a ripple voltage, the rectifier having a first terminal and a second terminal;
   - a light emitting unit partitioned into a plurality of groups, the group including a plurality of LEDs, the groups comprising at least two groups branched from the first terminal; and a driving controller for selectively driving one or more of the groups of the light emitting unit depending on a level of the ripple voltage, the driving controller driving at least one of the groups of the light emitting unit using current discharged from a capacitor connected with the at least one group when the ripple voltage is lower than an operating voltage of the light emitting unit.

15. The LED driving apparatus according to claim 14, wherein the light emitting unit comprises:

a first group disposed between the first terminal of the rectifier and the capacitor; and a second group connected to a discharge path of the capacitor.

16. The LED driving apparatus according to claim 15, wherein the light emitting unit further comprises a third group connected between the second group and the second terminal of the rectifier.

17. The LED driving apparatus according to claim 15, wherein the driving controller controls the first group such that the first group emits light in a phase state including a peak portion of the ripple voltage.

18. The LED driving apparatus according to claim 15, wherein the driving controller controls the second group such that the second group emits light in a phase state excluding a peak portion of the ripple voltage.

19. The LED driving apparatus according to claim 14, further comprising a dimming controller for controlling brightness of the light emitting unit.

20. The LED driving apparatus according to claim 14, wherein the driving controller controls a voltage charged in the capacitor within a voltage range lower than a maximum allowable charged voltage of the capacitor.

* * * * *